US007825946B2

(12) United States Patent
Sugiyama et al.

(10) Patent No.: US 7,825,946 B2
(45) Date of Patent: Nov. 2, 2010

(54) IMAGE FORMING APPARATUS

(75) Inventors: Yosuke Sugiyama, Gifu (JP); Junichi Yokoi, Toyoake (JP); Toshio Sakai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 97 days.

(21) Appl. No.: 12/244,292

(22) Filed: Oct. 2, 2008

(65) Prior Publication Data

US 2009/0116875 A1 May 7, 2009

(30) Foreign Application Priority Data

Oct. 2, 2007 (JP) ..... 2007-258594

(51) Int. Cl.
*B41J 15/14* (2006.01)
*B41J 27/00* (2006.01)

(52) U.S. Cl. ..... 347/242; 347/257

(58) Field of Classification Search ..... 347/241, 347/242, 245, 256, 257, 263
See application file for complete search history.

(56) References Cited

U.S. PATENT DOCUMENTS 4,258,372 A * 3/1981 Ishikawa ..... 347/149
6,055,006 A * 4/2000 Murano ..... 347/118
7,710,444 B2 * 5/2010 Hirayama et al. ..... 347/238

FOREIGN PATENT DOCUMENTS

| | | | |
|---|---|---|---|
| JP | 61095956 A | * | 5/1986 |
| JP | 63-018367 | | 1/1988 |
| JP | 63049780 A | * | 3/1988 |
| JP | 63-135265 | | 6/1988 |
| JP | 01-279272 | | 11/1989 |
| JP | 03-108249 | | 11/1991 |
| JP | 2007-072352 | | 3/2002 |
| JP | 2002-104694 | | 4/2002 |

* cited by examiner

*Primary Examiner*—Hai C Pham
(74) *Attorney, Agent, or Firm*—Banner & Witcoff, Ltd

(57) ABSTRACT

An image forming apparatus includes: a photosensitive body which is moved in a movement direction; an exposing unit which exposes the photosensitive body, and which includes a guide roller configured to contact with the photosensitive body and rotate with a movement of the photosensitive body and configured to regulate a positional relationship with the photosensitive body, the guider roller being disposed such that a rotation direction of the guide roller is inclined with respect to the movement direction so as to generate a force for urging the exposing unit to one end thereof in an orthogonal direction when the guide roller rotates, the orthogonal direction being orthogonal to the movement direction and to an optical axis direction of a light emitted from the exposing unit; and a regulating member configured to contact with the one end of the exposing unit to regulate a position of the exposing unit.

12 Claims, 6 Drawing Sheets

IMAGE FORMING APPARATUS

CROSS-REFERENCE TO RELATED APPLICATION

This application claims priority from Japanese Patent Application No. 2007-258594, filed on Oct. 2, 2007, the entire subject matter of which is incorporated herein by reference.

TECHNICAL FIELD

Aspects of the present invention relate to an image forming apparatus in which a photosensitive body and an exposing unit are disposed close to each other.

BACKGROUND

An image forming apparatus is configured such that a photosensitive body and the light-emitting face of an exposing unit (for example, a light-emitting diode (LED) head or the like) are disposed close to each other and the photosensitive body is exposed. Such image forming apparatus is required to have a mechanism that keeps the distance between the photosensitive body and the exposing unit constant. For example, in the image forming apparatus described in JP-A-1-279272, this distance is kept constant by providing a guide roller to an LED head to contact with a photosensitive drum.

The direction in which the guide roll rotates as the photosensitive body is moved, that is, the direction of the relative movement of the guide roller with respect to the photosensitive body, is determined by the posture of the guide roller. However, even if the rotation direction of the guide roller, that is, the posture of the guide roller, is adjusted so as to be accurately aligned with the movement direction of the photosensitive body, the guide roller may tend to rotate obliquely with respect to the movement direction of the photosensitive body due to an adjustment error and the clearance between the guide roller and the supporting shaft thereof. This oblique rotation of the guide roller with respect to the movement direction of the photosensitive body causes the LED head to wobble about the photosensitive body and cause deterioration in image formation.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus capable of keeping the positional relationship between an exposing unit such as an LED head and a photosensitive body constant.

According to an exemplary embodiment of the present invention, there is provided an image forming apparatus including: a photosensitive body which is moved in a movement direction; an exposing unit which emits a light to expose the photosensitive body, and which includes a guide roller configured to contact with the photosensitive body and rotate with a movement of the photosensitive body and configured to regulate a positional relationship with the photosensitive body, the guider roller being disposed such that a rotation direction of the guide roller is inclined with respect to the movement direction of the photosensitive body so as to generate a force for urging the exposing unit to one end thereof in an orthogonal direction when the guide roller rotates, the orthogonal direction being orthogonal to the movement direction of the photosensitive body and to an optical axis direction of a light emitted from the exposing unit; and a regulating member configured to contact with the one end of the exposing unit to regulate a position of the exposing unit.

According to another exemplary embodiment of the present invention, there is provided an image forming apparatus including: a photosensitive body which is moved in a movement direction; an exposing unit which emits a light to expose the photosensitive body, and which includes a guide roller configured to contact with the photosensitive body and rotate with a movement of the photosensitive body and configured to regulate a positional relationship with the photosensitive body, the guider roller including a surface having a tapered shape so as to generate a force urging the exposing unit to one end thereof in an orthogonal direction when the guide roller rotates, the orthogonal direction being orthogonal to the movement direction of the photosensitive body and to an optical axis direction of a light emitted from the exposing unit; and a regulating member configured to contact with the one end of the exposing unit to regulate a position of the exposing unit.

According to a further exemplary embodiment, there is provided an image forming apparatus including: a main body including an opening; a cover which is pivotable about an end of the opening and to open and close the opening; a photosensitive body which is provided in the main body and is moved in a movement direction; an exposing unit which includes a light-emitting head, a shaft and a roller rotatable about the shaft, and which is coupled to the cover and movable between an exposure position and a retraction position with a movement of the cover, wherein, in the exposure position, the light-emitting head faces the photosensitive body and the roller contact with the photosensitive body and rotates with a movement of the photosensitive body, and wherein, in the retraction position, the roller is separated from the photosensitive body; and a regulating member configured to contact with first end of the exposing unit, wherein the shaft is inclined with respect to the movement direction such that one end of the shaft closer to the first end of the exposing unit is positioned downstream of the movement direction of the photosensitive body compared with the other end of the shaft.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
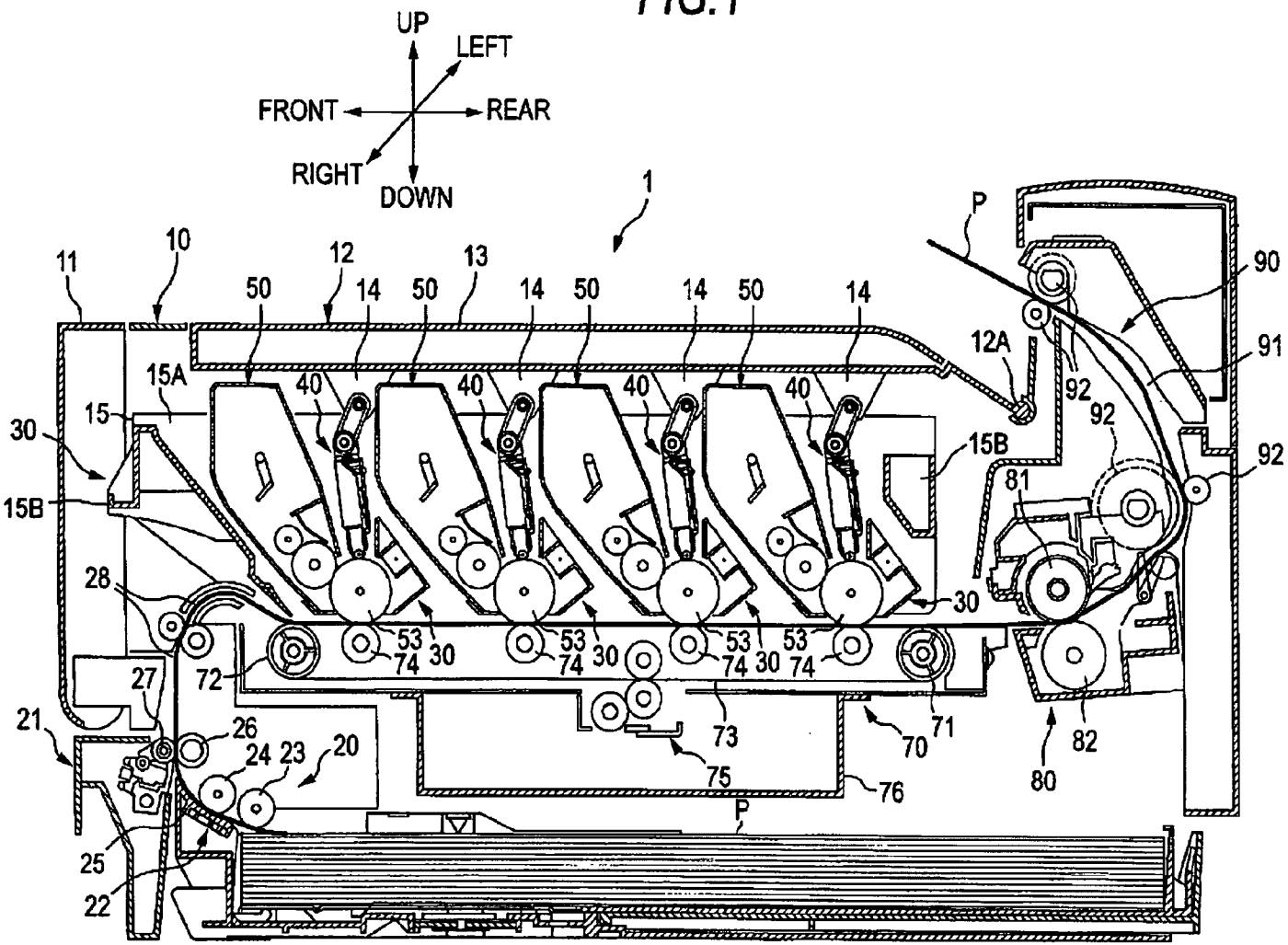
FIG. 1 is a sectional view showing the overall configuration of a color laser printer according to an exemplary embodiment of the present invention.
Figure 2:
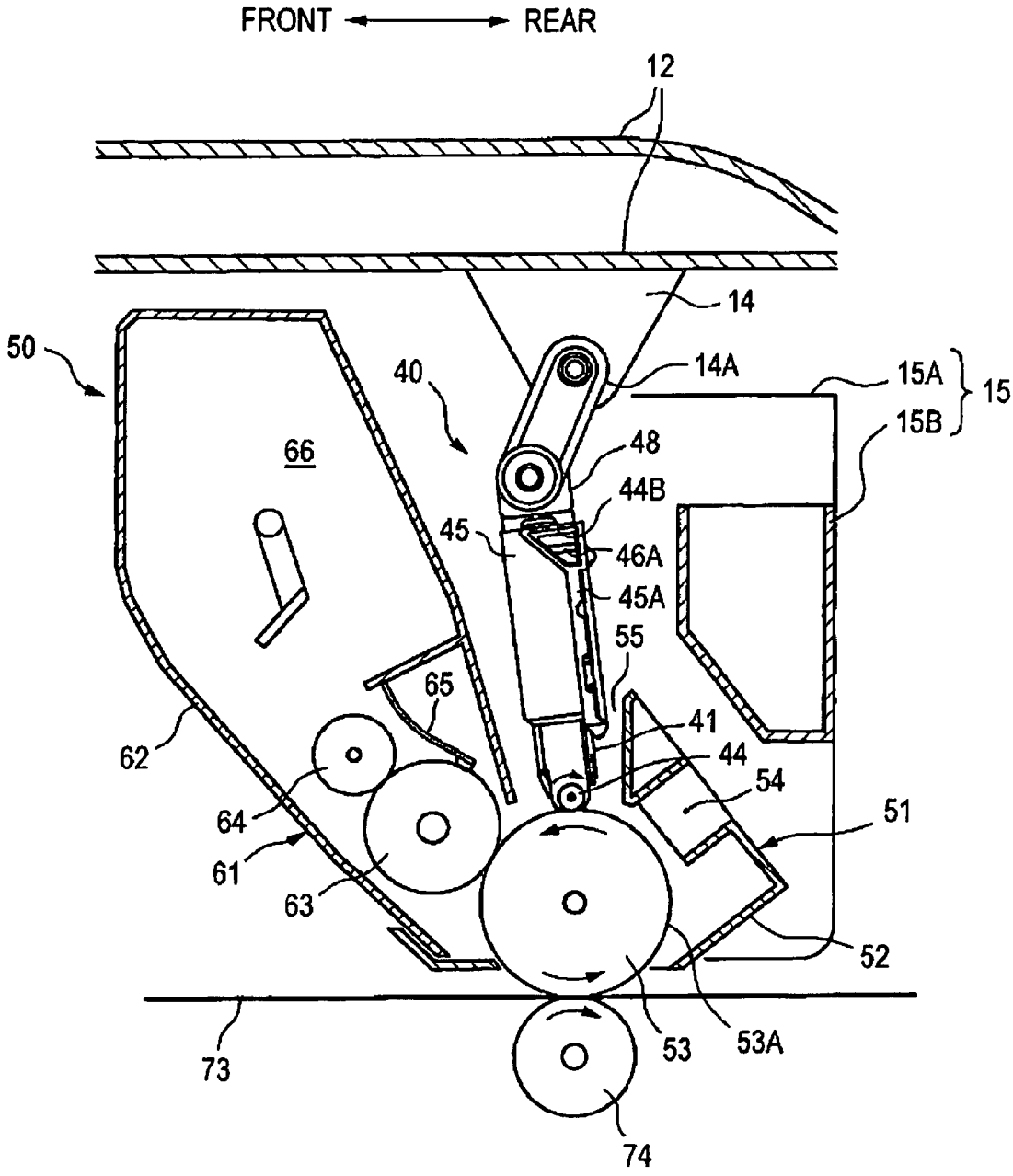
FIG. 2 is an enlarged view showing an LED unit and a process cartridge shown in FIG. 1.
Figures 3A, 3B:
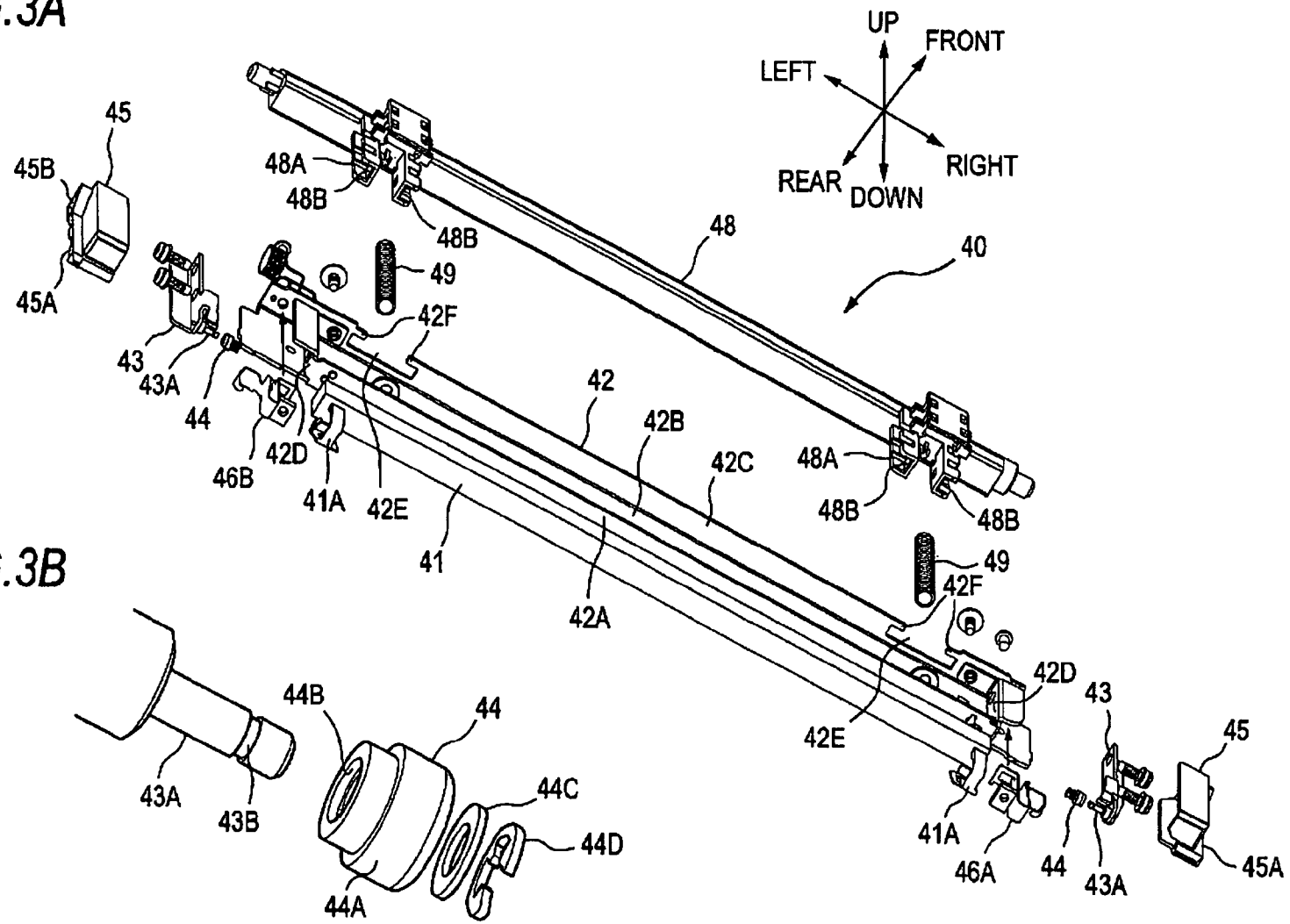
FIG. 3A is an exploded perspective view showing the LED unit.
FIG. 3B is an enlarged perspective view showing a guide roller.
Figure 4:
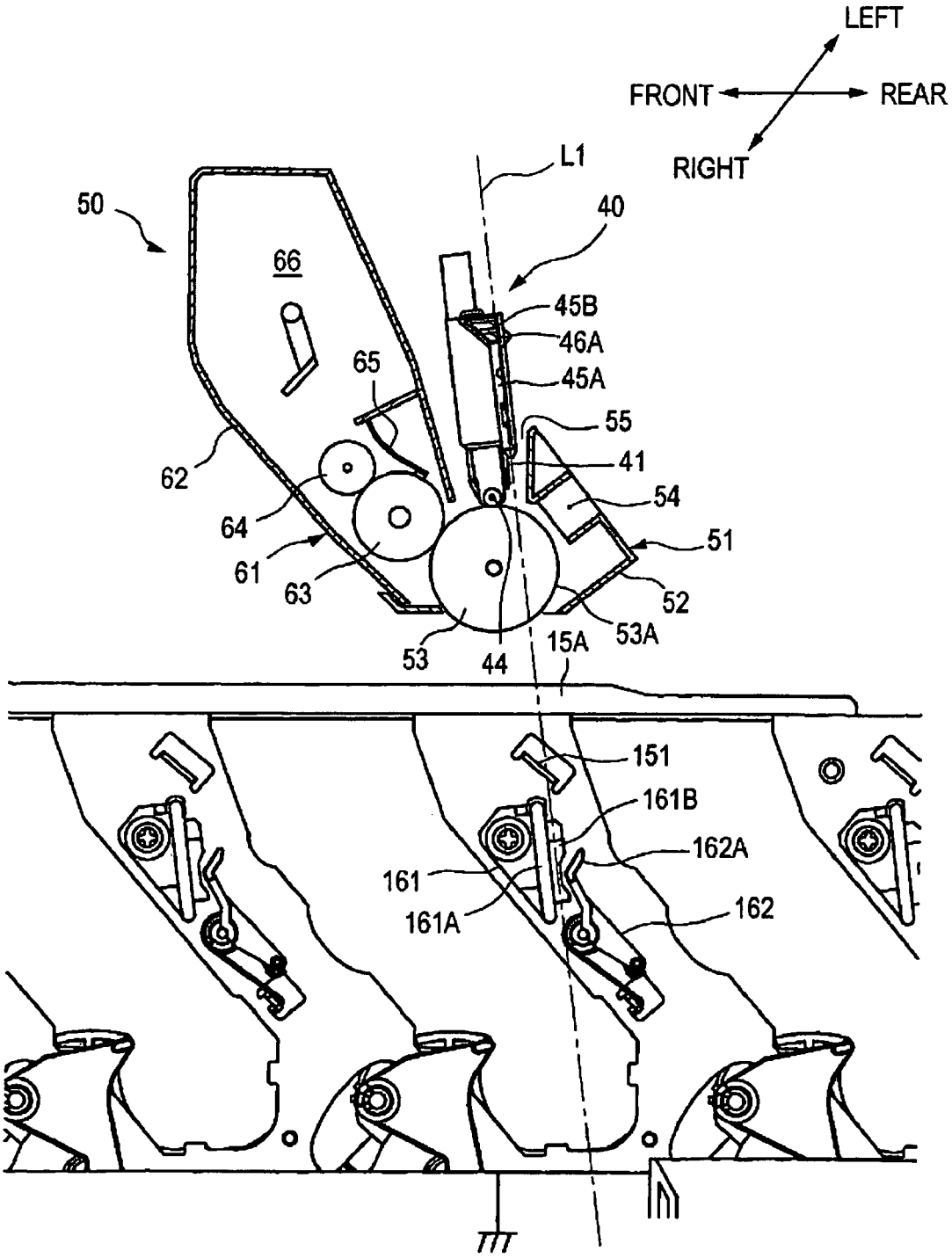
FIG. 4 is a side view showing the positional relationship between the LED unit and a side plate.
Figure 5A:
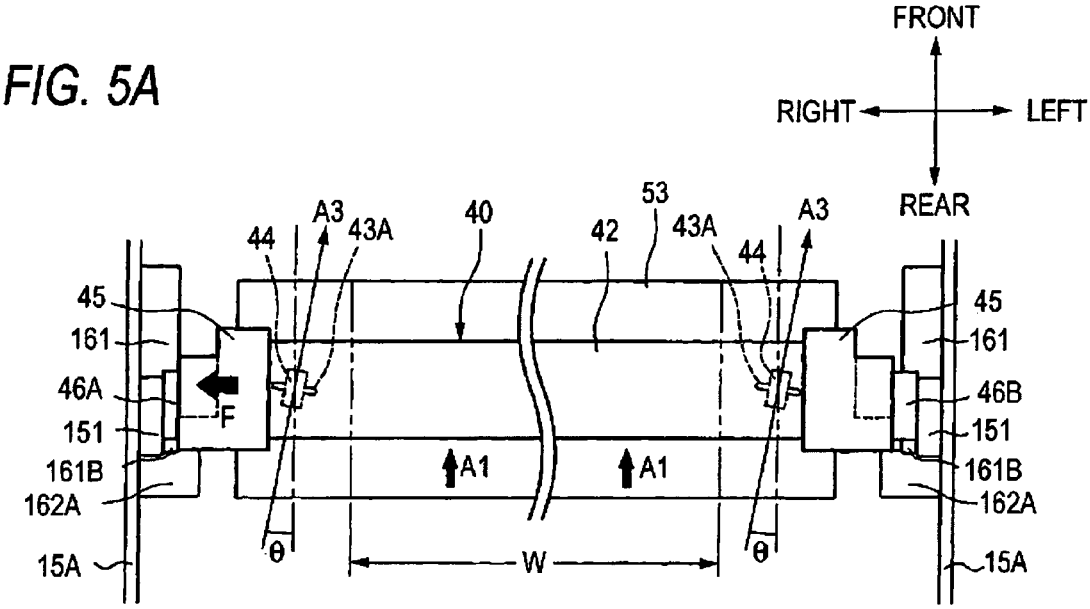
FIG. 5A is a view showing a photosensitive drum and the LED unit as viewed from above.
Figure 5B:
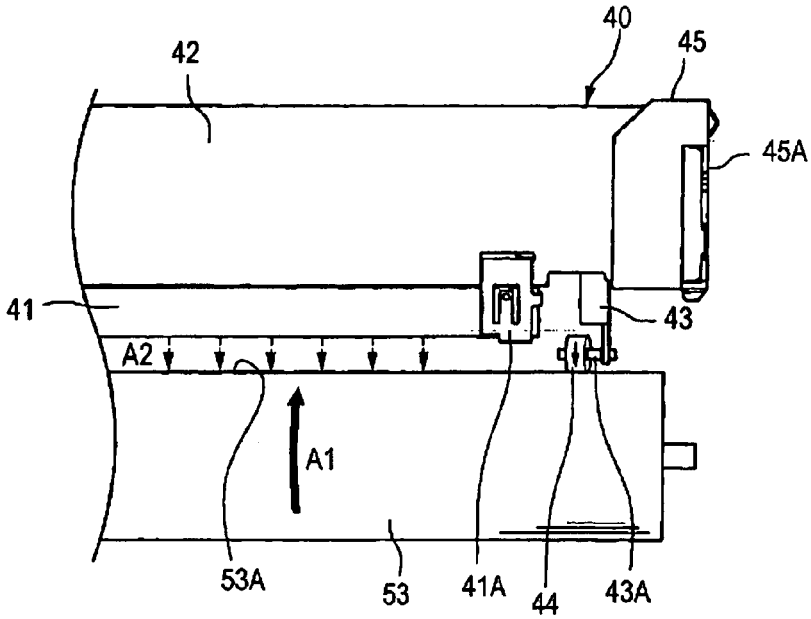
FIG. 5B is a view showing the photosensitive drum and the LED unit as viewed from rear.

Exemplary embodiments according to the present invention will be described in detail referring to the drawings. In the drawings, FIG. 1 is a sectional view showing the overall configuration of a color laser printer according to an exemplary embodiment of the present invention; FIG. 2 is an enlarged view showing an LED unit and a process cartridge shown in FIG. 1; FIG. 3A is an exploded perspective view showing the LED unit; FIG. 3B is an enlarged perspective view showing a guide roller; FIG. 4 is a side view showing the positional relationship between the LED unit and a side plate; FIG. 5A is a view showing a photosensitive drum and the LED unit as viewed from above; and FIG. 5B is a view showing the photosensitive drum and the LED unit as viewed from rear.

The directions referred to in the following description are described based on the user's using direction of the color laser printer. In other words, referring to FIG. 1, the left side is referred to as the "front side," the right side is referred to as the "rear side," the back side is referred to as the "left side," and the front side is referred to as the "right side." Furthermore, the up-down direction of the paper surface is referred to as the "vertical direction."

As shown in FIG. 1, a color laser printer 1 includes a sheet feeding unit 20 for feeding sheets P, an image forming unit 30 for forming images on the sheets P being fed and a sheet discharging unit 90 for discharging the sheets P on which images are formed, inside a main body housing 10.

On the front side of the main body housing 10, a front cover 11 is provided. The front cover 11 is pivotable about a lower portion thereof so that the front cover can be opened and closed in back and forth direction. On the upper portion of the main body housing 10, an upper cover 12 is provided. The upper cover 12 is pivotable about a hinge 12A provided on the rear side so that the upper cover 12 can be opened and closed in the vertical direction. The upper face of the upper cover 12 serves as a sheet discharging tray 13 for storing the sheets P discharged from the main body housing 10, and on the lower face thereof, multiple holding members 14 for holding LED units 40 described later are provided.

A main body frame 15 which is a part of the main body of the color laser printer 1 for detachably accommodating process cartridges 50 described later is provided inside the main body housing 10. The main body frame 15 includes a pair of side frames 15A (only one side is shown) provided on the left and right sides and a pair of cross members 15B provided on the front and rear sides for connecting the pair of side frames 15A. The main body frame 15 is secured to the main body housing 10, and the like. Furthermore, the side frames 15A serve as members for supporting the photosensitive drums 53 directly or indirectly.

The sheet feeding unit 20 is provided in the lower portion of the interior of the main body housing 10 and mainly includes a sheet feeding tray 21 detachably mounted on the main body housing 10 and a sheet feeding mechanism 22 for conveying the sheets P from the sheet feeding tray 21 to the image forming unit 30. The sheet feeding mechanism 22 is provided on the front side of the sheet feeding tray 21 and mainly includes a feed roller 23, a separation roller 24 and a separation pad 25.

In the sheet feeding unit 20 configured as described above, the sheets P inside the sheet feeding tray 21 are separated and fed upward one by one. While the sheets P pass between a paper powder removing roller 26 and a pinch roller 27, paper powder is removed. The sheets P then pass through a conveying passage 28 in which the direction thereof is converted to the backward direction, and the sheets P are fed to the image forming unit 30.

The image forming unit 30 mainly includes four LED units 40, four process cartridges 50, a transfer unit 70 and a fixing unit 80.

The process cartridges 50 are disposed so as to be arranged in the back and forth direction between the upper cover 12 and the sheet feeding unit 20. The process cartridge 50 includes a drum unit 51 and a developing unit 61 detachably mounted on the drum unit 51 as shown in FIG. 2. The process cartridges 50 are supported using the side frames 15A, and the photosensitive drums 53 are supported in the process cartridges 50. The process cartridges 50 have the same configuration except for the color of the toner accommodated in toner accommodating chamber 66 of the developing unit 61.

The drum unit 51 mainly includes a drum frame 52, the photosensitive drum 53 rotatably supported on the drum frame 52, and a scorotron charger 54. The photosensitive drum 53 has a circular cylindrical shape.

An exposure hole 55 through which the LED unit 40 is inserted from above is provided in the face of the drum frame 52 opposed to the photosensitive drum 53.

The developing unit 61 includes a developing frame 62, a developing roller 63 and a supply roller 64 rotatably supported on the developing frame 62, and a layer thickness regulating blade 65. Furthermore, the developing unit 61 includes the toner accommodating chamber 66 for accommodating toner.

The transfer unit 70 is provided between the sheet feeding unit 20 and the process cartridges 50 as shown in FIG. 1. The transfer unit mainly includes a drive roller 71, a driven roller 72, a conveying belt 73, transfer rollers 74 and a cleaning unit 75.

The drive roller 71 and the driven roller 72 are disposed in parallel while being apart in the back and forth direction, and the conveying belt 73 formed of an endless belt is wound therearound. The outer face of the conveying belt 73 contacts with the photosensitive drums 53. In addition, inside the conveying belt 73, four transfer rollers 74 are disposed so as to be opposed to the photosensitive drums 53, respectively such that the conveying belt 73 is held between each pair of the transfer roller 74 and the photosensitive drum 53. A transfer bias is applied to the transfer rollers 74 by constant current control at the time of transfer.

The cleaning unit 75 is disposed below the conveying belt 73 and is configured to remove the toner attached to the conveying belt 73 and to drop the removed toner to a toner retaining unit 76 disposed thereunder.

The fixing unit 80 is disposed behind the process cartridges 50 and the transfer unit 70. The fixing unit 80 includes a heating roller 81 and a pressing roller 82 which is disposed to be opposed to the heating roller 81 and which presses the heating roller 81.

In the image forming unit 30 configured as described above, first, the surface of each photosensitive drum 53 is uniformly charged using the scorotron charger 54 and then exposed to the LED light emitted from each LED unit 40. Hence, the potential at the exposed portion lowers, and an electrostatic latent image based on image data is formed on each photosensitive drum 53.

Furthermore, the toner inside the toner accommodating chamber 66 is supplied to the developing roller 63 by the rotation of the supply roller 64, brought in between the developing roller 63 and the layer thickness regulating blade 65 by the rotation of the developing roller 63 and held on the developing roller 63 as a thin layer having a constant thickness.

The toner held on the developing roller 63 is supplied to the electrostatic latent image formed on the photosensitive drum 53 while the developing roller 63 contacts with the photosensitive drum 53. As a result, the toner is selectively attached to the photosensitive drum 53, whereby the electrostatic latent image is converted into a visible image, that is, reversal development is carried out to form a toner image.

Next, a sheet P fed onto the conveying belt 73 passes between each pair of the photosensitive drum 53 and the transfer roller 74 disposed inside the conveying belt 73, whereby the toner image formed on each photosensitive drum 53 is transferred onto the sheet P.

The sheet P then passes between the heating roller 81 and the pressing roller 82, whereby the toner image transferred onto the sheet P is heat-fixed.

The sheet discharging unit 90 mainly includes a conveying passage 91 on the sheet discharging side formed so as to extend upward from the exit of the fixing unit 80 and to be returned to the front side and multiple pairs of conveying rollers 92 for conveying the sheets P. The sheet P to which the toner image is transferred and heat-fixed is conveyed through the conveying passage 91 on the sheet discharging side using the conveying rollers 92, discharged to the outside of the main body housing 10 and stored in the sheet discharging tray 13.

Next, the LED unit 40 and the configuration for positioning the LED unit 40 will be described in detail.

As shown in FIG. 3, the LED unit 40 includes an LED head 41 serving as an example of an exposing unit, an exposing unit frame 42, roller supporting members 43, guide rollers 44, resin covers 45, springs 46A and 46B serving as examples of urging members, and a suspender 48.

The LED head 41 includes multiple light-emitting units such as LEDs arranged in the left and right direction on the lower side thereof. In other words, the longitudinal direction of the LED head 41 is parallel to the axial direction of the photosensitive drum. The outer surface of the LED head 41 is made of resin in order to suppress discharge from high-voltage components such as the scorotron charger 54. Each light-emitting unit receives signals on the basis of the data of an image to be formed from a controller (not shown), and emits light, thereby exposing the photosensitive drum 53.

The exposing unit frame 42 supports the LED head 41. The exposing unit frame 42 is obtained by pressing a metal plate so as to have an approximately U-shaped cross section and has conductivity. More specifically, the exposing unit frame 42 includes a lower plate 42A, a side plate 42B and an upper plate 42C to form a member having an approximately U-shaped cross section and extending in the left and right direction. At both ends in the left and right direction of the lower plate 42A (hereafter simply referred to as "both ends"), end plates 42D are formed by bending the end portions of the lower plate 42A. In the upper plate 42C, openings 42E open on the front side are formed near both ends. At the opening end on the front side of the opening 42E, engaging pawls 42F extending inward in the left and right direction of the opening 42E is formed so as to narrow the opening 42E. The LED head 41 is installed and fixed on the lower plate 42A of the exposing unit frame 42 from the lower side of the exposing unit frame 42 using two clips 41A. The roller supporting members 43 are brackets obtained by pressing conductive metal plates and mounted on the end plates 42D with screws at both ends of the exposing unit frame 42. A roller shaft 43A extending inward in the left and right direction is provided at the lower end of the roller supporting member 43. The roller shaft 43A rotatably supports the guide roller 44, and an engaging groove 43B is formed in the circumferential direction as shown in FIG. 3B.

The guide roller 44 has an approximately cylindrical shape. In other words, the rolling face 44A thereof is formed to have a cylindrical shape. A shaft hole 44B into which the roller shaft 43A is fitted is formed along the center axis of the guide roller 44A. The guide roller 44 is installed on the roller shaft 43A by inserting the roller shaft 43A into the shaft hole 44B while fitting a washer 44C on the roller shaft 43A and engaging a clip 44D with the engaging groove 43B. That is, the extending direction of the roller shaft 43A is aligned with the direction of the rotation axis of the guide roller 44.

The guide rollers 44 contacts with the circumferential face 53A of the photosensitive drum 53 and rotates with a rotation of the photosensitive drum 53 as shown in FIG. 2, thereby regulating the relationship between the LED unit 40 and the photosensitive drum 53, more specifically, the distance between the light-emitting unit of the LED head 41 and the circumferential face 53A. Although the material of the guide roller 44 is not particularly limited, it is advantageous to use a material having an appropriate friction coefficient with the circumferential face 53A and being excellent in abrasion resistance. For example, a polyamide resin can be used.

The guide rollers 44 are disposed outside an image forming range (indicated by letter W in FIG. 5A) to which toner is supplied, on the circumferential face 53A of the photosensitive drum 53, so as not to adversely affect image formation.

The resin covers 45 covers the metal portions at both ends of the exposing unit frame 42. More specifically, the resin covers 45 are provided at both ends of the exposing unit frame 42 in the direction orthogonal to the movement direction (the direction indicated by arrows A1 shown in FIGS. 5A and 5B) of the circumferential face 53A of the photosensitive drum 53 and orthogonal to the optical axis direction (indicated by arrows A2 shown in FIG. 5B) of the light emitted from the LED unit 40. The direction orthogonal to the movement direction of the circumferential face 53A of the photosensitive drum 53 and orthogonal to the optical axis direction of the light emitted from the LED unit 40 is aligned with the direction of the rotation axis of the photosensitive drum 53.

The totally two resin covers 45 provided at the left and right positions are formed so as to be bilaterally symmetrical with each other. The resin covers 45 are made of an insulating resin material and formed so as to cover both end faces of the exposing unit frame 42 and the portions within a predetermined range from both ends. Guide ribs 45A extending in the vertical direction are formed so as to protrude at both ends in the left and right direction of the resin covers 45. The upper end of the guide rib 45A has a triangular contour as viewed from the left-right direction, and a through hole 45B is formed inside this triangular portion. Springs 46A and 46B are exposed through the through holes 45B.

The springs 46A and 46B are formed of a metallic leaf spring, have conductivity and are secured to both ends of the exposing unit frame 42 with screws or the like. The spring 46A is provided on one end side of the LED unit 40, and the spring 46B is provided on the other end side of the LED unit 40. The spring 46B disposed on the left side is formed of a metallic plate thicker than that of the spring 46A disposed on the right side, whereby the load generated by the spring 46B is larger than that generated by the spring 46A. Both end portions (the outer end portions in the left and right direction) of the springs 46A and 46B protrude from the through holes 45B of the resin covers 45 when no load is applied. The springs 46A and 46B are disposed at the same positions as viewed from the left and right direction. In other words, the springs 46A and 46B are disposed so as to be aligned in the direction orthogonal to the movement direction of the circumferential face 53A of the photosensitive drum 53 and orthogonal to the optical axis direction of the light emitted from the LED unit 40. Further, in other words, the springs 46A and 46B are disposed such that their projections in the left and right direction are overlapped. Hence, the urging forces generated with using the springs 46A and 46B are applied in the left and right direction and do not serve as forces to rotate the LED unit 40, thereby stabilizing the position of the LED unit 40.

The suspender 48 supports the exposing unit frame 42 and the LED head 41 in a suspending state. The suspender 48 is configured such that its length in the left and right direction is similar to that of the exposing unit frame 42, and is provided with engaging members 48A at two positions corresponding to the two openings 42E. In each of the engaging members 48A, a portion having a U-shaped cross section and being open outside in the left and right direction as viewed from below is formed, and this opening 48B having such a U-shaped cross section is engaged with the engaging pawls 42F described earlier while having clearances.

A compression spring 49 is disposed between each of the engaging members 48 and the exposing unit frame 42. The compression springs 49 are disposed inside in the left and right direction of the two guide rollers 44. After the engaging members 48A are engaged with the openings 42E and the engaging pawls 42F of the exposing unit frame 42 while having clearances and they are locked using retaining members (not shown), the exposing unit frame 42 and the LED head 41 are urged downward at all times using the compression springs 49.

The LED unit 40 configured as described above is installed on the holding member 14 via a connection link 14A, that is, the upper cover 12, as shown in FIG. 2. The connection link 14A is rotatable at the connection portion to the holding member 14 and at the connection portion to the LED unit 40 in the side view shown in FIG. 2, and the posture of the LED unit 40 can be changed as desired, whereby the LED unit 40 is easily engaged with the side frames 15A.

When the LED unit 40 is installed on the upper cover 12, the LED unit 40 extends downward from the upper cover 12. Since the upper cover 12 pivots about the hinge 12A provided on the rear side so as to be opened and closed as described above, the photosensitive drum 53 and the LED unit 40 can relatively move between an exposure position in which they are close to each other and a retraction position in which they are separated from each other. When the LED unit 40 is at the exposure position, the guide roller 44 provided at the lower end contacts with a portion near the upper end of the circumferential face 53A of the photosensitive drum 53, whereby the distance between the circumferential face 53A and the LED head 41 is maintained constant.

As shown in FIG. 4, on each of the side frames 15A, a front guide 161 and a rear guide 162 are provided at a portion in which each of the four LED units 40 is mounted and which corresponds to each of both end portions of the LED unit 40.

A rib 161A extending approximately in the vertical direction is formed on the front guide 161 so as to protrude inward in the left and right direction. The rib 161A is positioned on the front side of the guide rib 45A when the LED unit 40 is mounted. In addition, an abutting portion 161B is provided along the rib 161A at the rear fringe of the front guide 161. The abutting portion 161B includes a face with which the guide rib 45A corresponding to each of both extreme ends of the LED unit 40 can contact, and the abutting portion 161B on the right side contacts with one end side of the LED unit 40, thereby regulating the position in the left and right direction of the LED unit 40.

An arm 162A extending upward from below is formed on the rear guide 162. The arm 162A is positioned on the rear side of the guide rib 45A when the LED unit 40 is mounted.

Both the front guide 161 and the rear guide 162 are made of resin, whereby the abrasion due to the sliding contact with the LED unit 40 is suppressed.

On each of the side frames 15A, a spring contact portion 151 obtained by bending a part of the side frame 15A inward in the left and right direction so as to rise is formed at an appropriately upper portion of the abutting portion 161B. The spring contact portion 151 is disposed at a position at which the spring contact portion 151 contacts with the spring 46A or the spring 46B when the LED unit 40 is mounted. Furthermore, the side frames 15A are electrically grounded as shown in FIG. 4.

As a result, the exposing unit frames 42 are electrically grounded via the springs 46A and 46B and the side frames 15A. The spring contact portion 151 shown in FIG. 4 contacts with the spring 46B on the left side. The spring contact portion 151 on the right side shown in FIG. 5A (the left side of the paper surface of FIG. 5A) contacts with the spring 46A on the right side. The contact portion on the one end side and the contact portion on the other end side are provided on the side frames 15A as described above, the LED unit 40 can be positioned accurately with respect to the photosensitive drum 53.

The guide rib 45A is inserted between the rib 161A and the arm 162A along line L1 and mounted on the side frames 15A configured as described above when the LED unit 40 is changed from the retraction position to the exposure position. In FIG. 4, line L1 is shown so as to extend linearly upward so that the mounting position is made clear. However, since the LED unit 40 is lowered as the upper cover 12 is rotated when the LED unit 40 is actually mounted, the LED unit 40 does not move linearly.

As shown in FIGS. 5A and 5B, the roller shaft 43A is slightly inclined in the left and right direction, in other words, leftward with respect to the direction orthogonal to the movement direction (indicated by arrows A1) of the circumferential face 53A of the photosensitive drum 53. More specifically, the roller shaft 43A is inclined such that the left end portion of the roller shaft 43A is positioned closer to the upstream side in the rotation direction of the photosensitive drum 53, that is, the rear side, than the right end portion thereof. Hence, the rotation direction of the guide roller 44 is also inclined slightly leftward with respect to the movement direction of the circumferential face 53 A. In other words, the rotation direction of the guide roller 44 according to this exemplary embodiment has a component directed to the left side. The rotation direction is the movement direction of the portion of the circumferential face of the guide roller 44 contacting with the circumferential face 53A of the photosensitive drum 53 and is indicated by arrow A3 shown in FIG. 5A. It is advantageous that the angle θ of the rotation direction of the guide roller 44 with respect to the movement direction of the circumferential face 53A is 1 to 5 degrees.

Since the guide roller 44 is disposed such that its rotation direction is inclined with respect to the movement direction of the circumferential face 53A of the photosensitive drum 53 as described above, it is possible to generate a force for urging the LED unit 40 to the right end side in the direction orthogonal to the movement direction of the circumferential face 53A of the photosensitive drum 53 and orthogonal to the optical axis direction of the light emitted from the LED unit 40.

The effect of the color laser printer 1 configured as described above will be described below.

When the process cartridge 50 of the color laser printer 1 is replaced or maintained, first, the upper cover 12 is rotated upward so as to opened, and the LED unit 40 is moved from the exposure position to the retraction position. Then, the front cover 11 is opened as necessary and required maintenance or the like is performed.

In the color laser printer 1 according to this exemplary embodiment, the LED unit 40 can move between the exposure position and the retraction position with respect to the photosensitive drum 53 as described above, it is necessary to determine the position of the LED unit 40 with respect to the photosensitive drum 53.

After the maintenance is completed, the front cover 11 is closed, and the upper cover 12 is lowered and closed. At this time, the guide roller 44 provided at the tip end (lower end) of the LED unit 40 contacts with the circumferential face 53A of the photosensitive drum 53 as shown in FIG. 2. As a result, the distance between the circumferential face 53A and the light-emitting unit of the LED head 41 is kept constant.

When image formation starts, the sheets P are fed one by one to the image forming unit 30. In the image forming unit 30, the photosensitive drums 53 are driven and rotated, and toner images are transferred to the sheets P between each pair of the photosensitive drum 53 and the transfer roller 74. At this time, the guide roller 44 rotates while contacting with the photosensitive drum 53 as the photosensitive drum 53 rotates. Since the rotation direction (indicated by arrow A3) of the guide roller 44 is inclined leftward with respect to the movement direction (indicated by arrows A1) of the circumferential face 53A as shown in FIG. 5A, force F (see FIG. 5A) for urging the LED unit 40 to the one end side (the right side), that is, the right side, is generated. Hence, the guide rib 45A on one end side contacts with the abutting portion 161B on the one end side, and the position of the LED unit 40 is surely determined. As a result, the positional relationship between the photosensitive drum 53 and the LED unit 40 is kept constant, and image quality can be improved.

In addition, the LED unit 40 includes the strong spring 46B on the other end side (the left side), and the spring 46B contacts with the spring contact portion 151 on the left side and generates an urging force for urging the LED unit 40 to the right side. At the same time, the weak spring 46A provided on the one end side contacts with the spring contact portion 151 on the right side and generates an urging force for urging the LED unit 40 to the left side. However, since the urging force by the spring 46A is weaker than that of the spring 46B, the LED unit 40 is urged as a whole to the one end side (the right side), and the guide rib 45A disposed at the end portion of the resin cover 45 on the one end side (the right side) contacts with the abutting portion 161B on the one end side (the right side). The position in the left and right direction of the LED unit 40 is surely determined by the contact between the guide rib 45A and the abutting portion 161B.

Furthermore, since the direction of the force for urging the LED unit 40 using the springs 46A and 46B is always aligned with the direction of the force for urging the LED unit 40 in the left and right direction using the guide rollers 44 in this exemplary embodiment, the guide rib 45A on the one end side can be surely made contact with the abutting portion 161B on the one end side. Since the guide rib 45A can be surely made contact with the abutting portion 161 as described above, unsteady movement in the left and right direction due to the antagonism between the urging force generated using the guide rollers 44 and the urging force generated using the springs 46A and 46B does not occur in the LED unit 40. As a result, the positional relationship between the photosensitive drum 53 and the LED unit 40 is kept constant, and image quality can be improved.

In particular, since the LED unit 40 is urged to the right side not only by the urging force generated using the guide rollers 44 but also by the urging force generated using the spring 46B in this exemplary embodiment, the LED unit 40 can be surely pushed to the right side and positioned. As a result, the positional relationship between the photosensitive drum 53 and the LED unit 40 is kept constant, and image quality can be improved.

Furthermore, in this exemplary embodiment, in addition to the spring 46B on the other end side, the spring 46A that is weaker than the spring 46B is disposed on the one end side to generate a force for urging the LED unit 40 to the other end side, whereby the LED unit 40 can be supported stably. As a result, the positional relationship between the photosensitive drum 53 and the LED unit 40 is kept constant, and image quality can be improved.

Since the positional accuracy in the left and right direction of the LED unit 40 is improved as described above, image quality in the color laser printer 1 according to this exemplary embodiment is improved.

In addition, since both ends of the exposing unit frame 42 are covered with the insulating resin covers 45, the possibility of discharge from high-voltage components such as the scorotron charger 54 to the exposing unit frame 42 can be reduced. As a result, the adverse effect of electrical noise to the LED head 41 can be suppressed, and image quality can be improved. Moreover, since at least one of the abutting portion 161B and the guide rib 45A is made of resin, the abrasion due to the sliding contact therebetween is suppressed. In particular, since both of the abutting portion 161B and the guide rib 45A are made of resin in this exemplary embodiment, the abrasion due to the sliding contact therebetween is suppressed further.

Further, since the exposing unit frame 42 and the springs 46A and 46B are electrically grounded via the side frames 15A, unexpected electric currents flowing through the exposing unit frame 42 and the springs 46A and 46B can be eliminated.

Since the springs 46A and 46B are aligned in the direction orthogonal to the movement direction of the circumferential face 53A of the photosensitive drum 53 and orthogonal to the optical axis direction of the light emitted from the LED unit 40, the urging forces generated using the springs 46A and 46B are applied in the left and right direction and do not serve as forces to rotate the LED unit 40, whereby the position of the LED unit 40 can be stabilized. As a result, the positional relationship between the photosensitive drum 53 and the LED unit 40 is kept constant, and image quality can be improved.

While the present invention has been shown and described with reference to certain exemplary embodiments thereof, it will be understood by those skilled in the art that various changes in form and details may be made therein without departing from the spirit and scope of the invention as defined by the appended claims.

Although the multiple LEDs is employed as multiple light-emitting units in the above-described exemplary embodiment, only one light-emitting element such as an LED may also be used to form the multiple light-emitting units. For example, it may be possible to have a configuration in which one backlight such as a fluorescent lamp is prepared and an optical shutter incorporating liquid crystal or PLZT elements arranged in a row in the left and right direction may be provided outside the backlight. Furthermore, the light-emitting units may be arranged in multiple rows, instead of being arranged in a row in the left and right direction. Moreover, the light-emitting elements are not limited to LEDs, but EL (electroluminescence) elements, fluorescent substances, etc. may also be used.

Figure 6A:
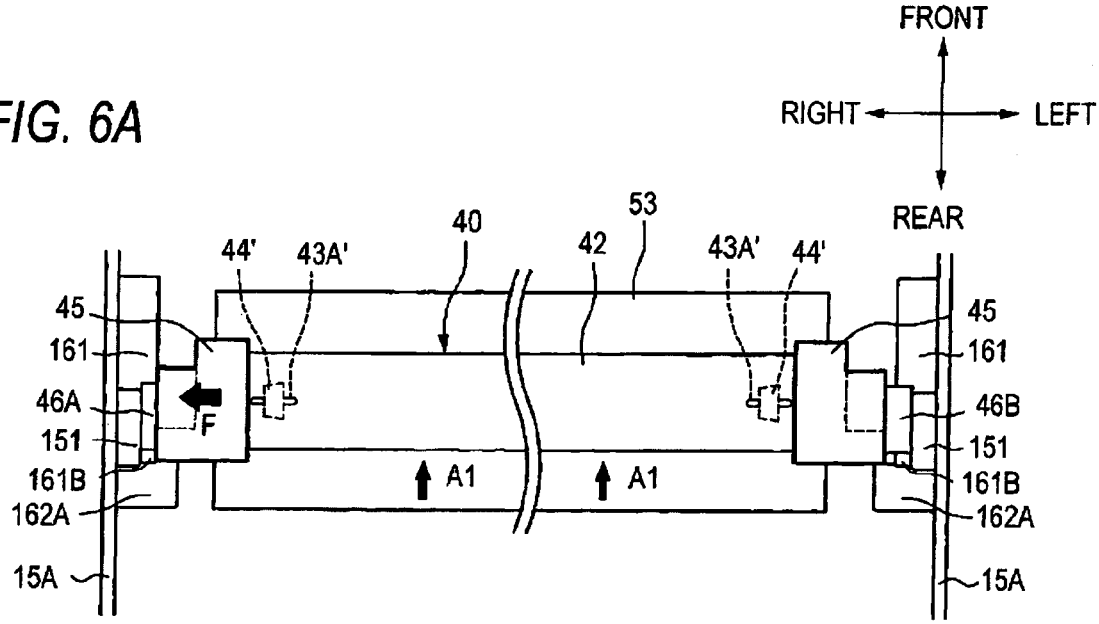
FIG. 6A is a view showing a photosensitive drum and an LED unit according to a modified exemplary embodiment as viewed from above.
Figure 6B:
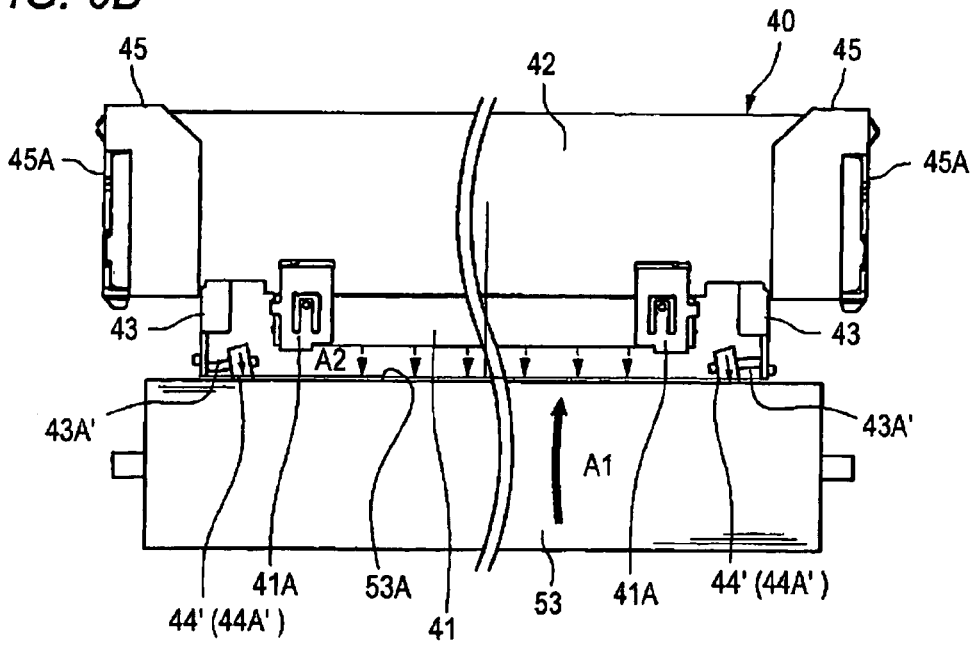
FIG. 6B is a view showing the photosensitive drum and the LED unit as viewed from rear.

Although the rolling face 44A of the guide roller 44 is formed to have a cylindrical face in the above-described exemplary embodiment, the guide roller 44 is not necessarily limited to have this shape but may have a crown shape. Furthermore, as in the case of a modified exemplary embodiment shown in FIGS. 6A and 6B, it is also possible to have a configuration in which both the rolling faces 44A' of the left and right guide rollers 44 are formed to have a tapered shape that narrows toward the one end side (the right side) and in which one end of the roller shaft 43A' is inclined upward or downward so that the rolling face 44A' contacts with the circumferential face 53A. According to this modified exemplary embodiment, the roller shaft 43A' may be arranged along in the left and right direction as viewed from above as shown in FIG. 6A and is not required to be inclined. Also in the configuration in which the rolling face 44A' of the guide roller 44' is formed to have a tapered shape as described above, when the guide roller 44' is rotated as the photosensitive drum 53 is rotated, the guide roller 44' tends to rotates while turning to the narrower side of the taper, whereby the LED unit 40 is urged to the one end side (right side). Accordingly, the LED unit 40 can be positioned while being abutted to the abutting portion 161B on the one end side at all times. As a result, the positional relationship between the photosensitive drum 53 and the LED unit 40 is kept constant, and image quality can be improved.

Although the resin covers 45 are provided at both ends of the exposing unit frame 42 in the above-mentioned exemplary embodiment, discharge from high-voltage components can be suppressed even when the resin cover 45 is provided only at one end. Furthermore, either the abutting portion 161B or the portion of the LED unit 40 contacting with the abutting portion 161B should only be made of resin to suppress the abrasion due to the sliding contact between the abutting portion 161B and the LED unit 40.

Although both of two guide rollers 44 are inclined with respect to the movement direction of the photosensitive drum 53, only one of the guide rollers 44 may be inclined and the other of the guide rollers may not be inclined.

Although a color printer of the electrophotographic type is described in detail in the above exemplary embodiment as an example of an image forming apparatus, the present invention is not only applicable to such color printers, but also applicable to monochromatic printers, copiers and multi-function devices.

Although the photosensitive drum 53 is employed as a photosensitive body in the above-described exemplary embodiment, the photosensitive body may have the shape of an endless belt or a flat face.

What is claimed is:

1. An image forming apparatus comprising:

a photosensitive body which is moved in a movement direction;

an exposing unit which emits a light to expose the photosensitive body, and which includes a guide roller configured to contact with the photosensitive body and rotate with a movement of the photosensitive body and configured to regulate a positional relationship with the photosensitive body, the guide roller being disposed such that a rotation direction of the guide roller is inclined with respect to the movement direction of the photosensitive body so as to generate a force for urging the exposing unit to one end thereof in an orthogonal direction when the guide roller rotates, the orthogonal direction being orthogonal to the movement direction of the photosensitive body and to an optical axis direction of a light emitted from the exposing unit; and a regulating member configured to contact with the one end of the exposing unit to regulate a position of the exposing unit.

2. The image forming apparatus according to claim 1, further comprising an urging member which urges the exposing unit to the one end of thereof.

3. The image forming apparatus according to claim 2, wherein the urging member includes a first spring provided at the other end of the exposing unit, wherein a main body of the image forming apparatus includes a first contact portion at the other end of the exposing unit, and wherein the first spring contacts with the first contact portion to urge the exposing unit to the one end thereof.

4. The image forming apparatus according to claim 3, wherein the urging member further includes a second spring provided at the one end of the exposing unit, the second spring being weaker than the first spring, wherein the main body of the image forming apparatus further includes a second contact portion at the one end of the exposing unit, wherein the second spring contacts with the second contact portion to urge the exposing unit to the other end thereof, and wherein the exposing unit is urged to the one end thereof as a whole by the first spring and the second spring.

5. The image forming apparatus according to claim 4, wherein the main body of the image forming apparatus includes a side frame, and wherein the first contact portion and the second contact portion are provided on the side frame.

6. The image forming apparatus according to claim 4, wherein the first spring and the second spring are aligned in the orthogonal direction.

7. The image forming apparatus according to claim 1, wherein the exposing unit includes:

an exposing device having an emitting portion which emits a light;

and a frame which is conductive and supports the exposing device, wherein at least one of the regulating member and an end portion of the frame, which contacts with the regulating member includes a resin member.

8. The image forming apparatus according to claim 7, wherein the frame includes end portions in the orthogonal direction, and wherein at least one of the end portions of the frame is provided with an insulating resin member.

9. The image forming apparatus according to claim 1, wherein the exposing unit comprises a light head including a plurality of light-emitting units.

10. The image forming apparatus according to claim 9, wherein the photosensitive body includes a photosensitive drum having a circular cylindrical shape.

11. The image forming apparatus according to claim 10, wherein a longitudinal direction of the exposing unit is parallel to an axial direction of the photosensitive drum.

12. An image forming apparatus comprising:

a main body including an opening;

a cover which is pivotable about an end of the opening and to open and close the opening;

a photosensitive body which is provided in the main body and is moved in a movement direction;

an exposing unit which includes a light-emitting head, a shaft and a roller rotatable about the shaft, and which is coupled to the cover and movable between an exposure position and a retraction position with a movement of the cover, wherein, in the exposure position, the light-emitting head faces the photosensitive body and the roller contact with the photosensitive body and rotates with a movement of the photosensitive body, and wherein, in the retraction position, the roller is separated from the photosensitive body; and a regulating member configured to contact with first end of the exposing unit, wherein the shaft is inclined with respect to the movement direction such that one end of the shaft closer to the first end of the exposing unit is positioned downstream of the movement direction of the photosensitive body compared with the other end of the shaft.

* * * * *